US006793508B2

(12) United States Patent
Chang

(10) Patent No.: US 6,793,508 B2
(45) Date of Patent: Sep. 21, 2004

(54) RECEPTACLE CONNECTOR ASSEMBLY FOR ELECTRONIC MEMORY CARD

(75) Inventor: Wei-Sun Chang, Peitou Area (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/444,325

(22) Filed: May 23, 2003

(65) Prior Publication Data

US 2003/0236012 A1 Dec. 25, 2003

(30) Foreign Application Priority Data

May 23, 2002 (TW) ..... 91207473 U

(51) Int. Cl.[7] ..... H01R 13/648
(52) U.S. Cl. ..... 439/95; 439/189
(58) Field of Search ..... 439/95, 189, 108, 439/101, 507

(56) References Cited

U.S. PATENT DOCUMENTS 5,564,933 A 10/1996 Bouchan et al. ..... 439/76.1
5,920,460 A 7/1999 Oldendorf et al. ..... 361/753
5,934,941 A * 8/1999 Hirai et al. ..... 439/607
6,067,710 A 5/2000 Sakaoka et al. ..... 29/842
6,241,556 B1 * 6/2001 Chih ..... 439/607
6,247,967 B1 * 6/2001 Wu et al. ..... 439/607
6,361,365 B1 * 3/2002 Yu ..... 439/607
6,375,498 B1 * 4/2002 Yu et al. ..... 439/567
6,482,016 B1 * 11/2002 McHugh et al. ..... 439/79
6,540,556 B1 4/2003 Fu ..... 439/607

* cited by examiner

*Primary Examiner*—Tulsidas C. Patel
(74) *Attorney, Agent, or Firm*—Stacey E. Caldwell

(57) ABSTRACT

A receptacle connector assembly for an electronic memory card provides and maintains a well-grounded connection between cover plates of the memory card via resilient contacts of a ground contact of the receptacle connector assembly. A memory card includes two conductive cover plates sandwiching the receptacle connector assembly. The receptacle connector assembly comprises an insulative housing formed with two rows of terminal receiving cavities for receiving signal and ground terminals. A distal terminal receiving cavity includes first and second partitions defining first and second ground terminal receiving cavities for receiving first and second ground terminals, and an insertion slot for receiving a ground element. The first and second partitions are formed with a cutout. A ground element positioned in the insertion slot includes a body, two wings extending from opposite ends of the body, and resilient contacts extending from the body inwardly of the wings. The wings make contact with the cover plates and the resilient contacts contact the first and second ground terminals via the cutouts to common the cover plates and ensure that the cover plates are at a common electrical potential despite any fluctuations in manufacturing or assembly tolerances.

5 Claims, 6 Drawing Sheets

RECEPTACLE CONNECTOR ASSEMBLY FOR ELECTRONIC MEMORY CARD

FIELD OF THE INVENTION

The present invention relates to a receptacle connector assembly structure for an electronic memory card, and particularly to a receptacle connector assembly structure that is effective in providing and maintaining a ground connection between the cover plates of the memory card despite fluctuations in assembly and manufacturing tolerances.

DESCRIPTION OF THE PRIOR ART

Due to the increasing frequency and efficiency of electrical products, the demands of grounding these products are similarly increasing and often becoming an essential element of avoiding electrical problems during the use of the products.

An electronic memory card generally comprises a receptacle connector assembly sandwiched between a pair of upper and lower cover plates. Referring to the FIG. 1, a receptacle connector assembly is shown (without the upper and lower cover plates). The receptacle connector assembly 1A includes an insulative housing 10A formed with two rows of terminal receiving cavities 11A, a plurality of signal terminals 12A received in the terminal receiving cavities 11A, a first ground terminal 20A, a second ground terminal 30A, and a ground element 40A. Each row of terminal receiving cavities 11A includes first and second distal or end terminal receiving cavities 50A and 60A, which respectively receive first and second ground terminals 20A and 30A (first and second ground terminals 20A and 30A use the same configuration as the signal terminal, but functionally are used to ground, not to transmit signals.) A slot is formed between the distal end of insulative housing 10A and first and second distal terminal receiving cavities 50A and 60A for receiving ground element 40A. A central portion of ground element 40A contacts first and second ground terminals 20A and 30A, and two wings of ground element 40A contact the upper and lower cover plates thereby electrically commoning the upper and lower cover plates.

However, ground element 40A of the receptacle connector assembly 1A utilizes a surface contact requiring specific and sensitive tolerances in order to contact first and second ground terminals 20A and 30A. Accordingly, this configuration has some disadvantages. For example, during manufacturing, the tolerances between first distal terminal receiving cavity 50A and first ground terminal 20A and second distal terminal receiving cavity 60A and second ground terminal 30A must be very accurate. If any of the tolerances is not accurate, ground element 40A may not be effective in contacting the first or second ground terminals which could result in the cover plates not being at the same ground potential and damaging the electrical performance of the memory card.

Because the tolerances between the terminal receiving cavities and the ground terminals must be accurate, the manufacturing process becomes more difficult and costly in terms of time and money.

It would be desirable if the above problem inherent in the prior art could be resolved. This problem is addressed and resolved by the present invention as set forth below.

SUMMARY OF THE INVENTION

An object of the present invention is to provide a receptacle connector assembly for an electronic memory card in which the receptacle connector assembly is effective in providing and maintaining an improved ground connection between cover plates of the memory card and avoid problems such as intermittencies due to sensitive manufacturing and assembly tolerances.

In order to achieve the above objects, the present invention according to one aspect thereof provides a receptacle connector assembly for an electronic memory card connector, wherein the card includes upper and lower cover plates, and a receptacle connector assembly is positioned between the cover plates. The receptacle connector assembly comprises an insulative housing having two rows of terminal receiving cavities including distal terminal receiving cavities at at least one end of each row. The distal terminal receiving cavities include first and second partitions defining first and second ground terminal receiving cavities on one side, and a single insertion slot on the other side. The first and second partitions are each formed with a cutout. Signal terminals are received in the terminal receiving cavities. A first ground terminal is received in the first ground terminal receiving cavity. A second ground terminal is received in the second ground terminal receiving cavity. A ground element is received in the insertion slot and includes a body, two wings extending from opposite ends of the body, and first and second resilient contacts extending from the body inward of the wings. When the ground element is properly positioned in the housing the wings are positioned at opposite ends of the insertion slot and contact the upper and lower cover plates to electrically ground the plates to a common potential, and the first and second resilient contacts contact the first and second ground terminals, respectively.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
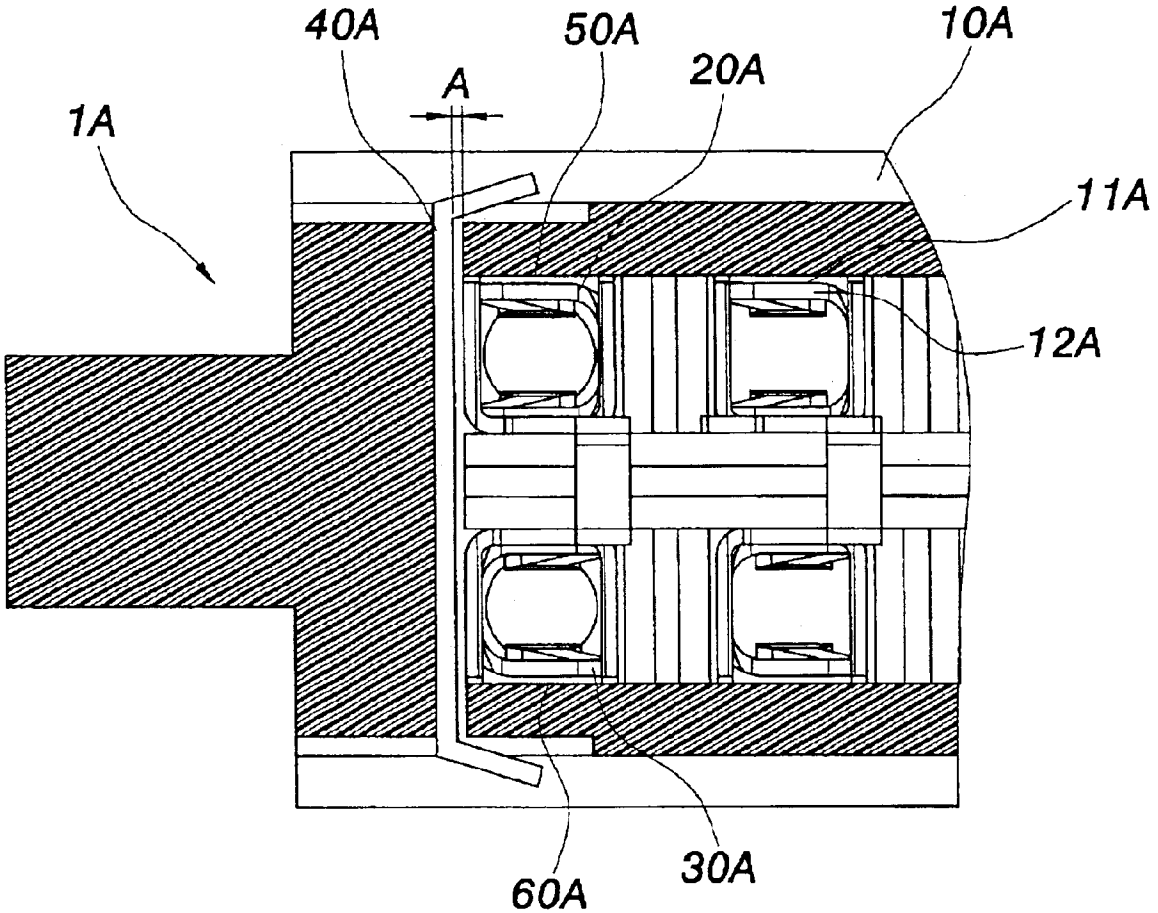
FIG. 1 PRIOR ART
FIG. 1 is a cross-sectional view of a receptacle connector assembly without upper and lower cover plates in accordance with the prior art.
Figure 2:
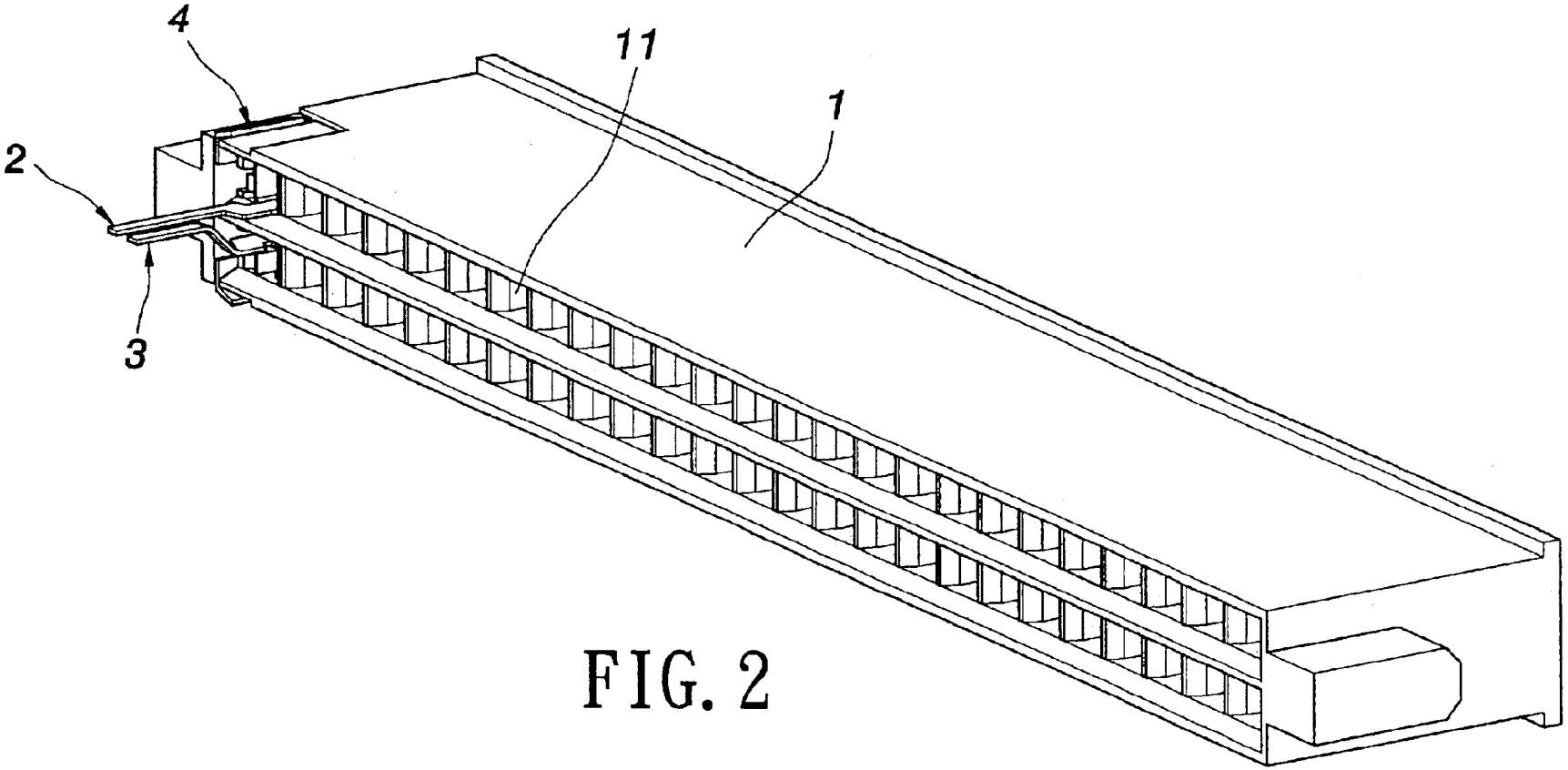
FIG. 2 is a perspective view of a receptacle connector assembly without upper and lower cover plates in accordance with the present invention.
Figure 3:
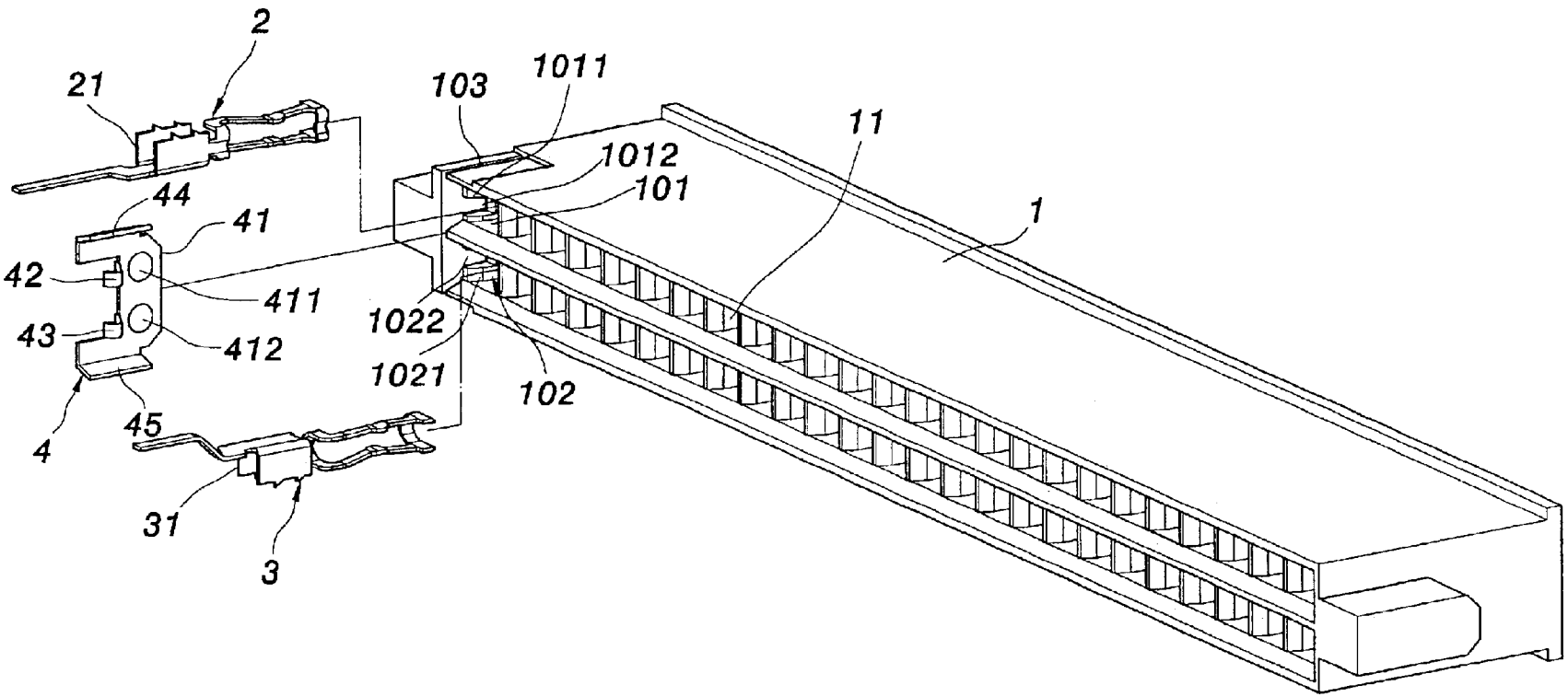
FIG. 3 is an exposed perspective view of a receptacle connector assembly without upper and lower cover plates in accordance with the present invention.

Referring to FIGS. 2 and 3, the present invention provides a receptacle connector assembly for an electronic memory card. The receptacle connector assembly comprises an insulative housing 1 having a plurality of terminal receiving cavities 11, a plurality of signal terminals (not shown) received in the corresponding terminal receiving cavities 11, a first ground terminal 2, a second ground terminal 3, and a ground element 4. The first ground terminal 2 and the second ground terminal 3 are each formed with first and second interfering portions 21 and 31 for engaging in and retaining the ground terminals within the terminal receiving cavities 11.

Insulative housing 1 has two rows of terminal receiving cavities; each row includes two distal terminal receiving cavities on at least one end thereof. One distal end of insulative housing 1 has two end or distal terminal receiving cavities one above the other, which have first and second partitions 1011 and 1021 respectively defining a first and second ground terminal receiving cavities 101 and 102 on one side of the partition, and a ground terminal insertion slot 103 on the other side of the partition. The first and second ground terminal receiving cavity 101 and 102 respectively receive first ground terminal 2 and second ground terminal 3. First and second partitions 1011 and 1021 are each formed with cutouts 1012, 1022, respectively. Insertion slot 103 vertically extends through upper and lower walls of insulative housing 1, so as to connect insertion slot 103 with first and second ground terminal receiving cavities 101 and 102 via cutouts 1012 and 1022.

Ground element 4 includes a body 41, two wings 44 and 45 extending from opposite ends of the body, and resilient contacts 42 and 43 extending from the body inwardly of wings 44 and 45. When ground element 4 is positioned in insertion slot 103, wings 44 and 45 are positioned at the upper and lower ends of insertion slot 103, and resilient contacts 42 and 43 are received in cutouts 1012 and 1022, for purposes described in more detail below.

Figure 4:
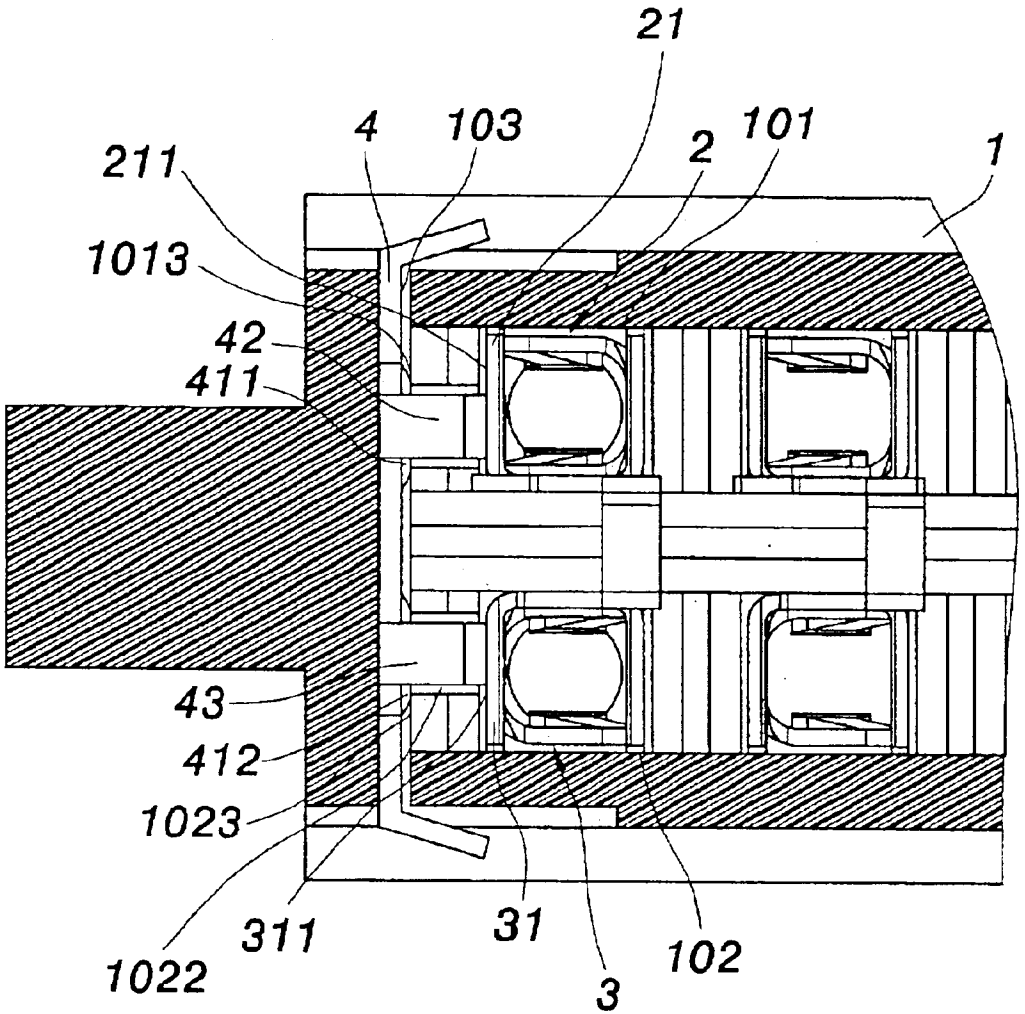
FIG. 4 is a cross-sectional view of FIG. 2.

Referring to FIG. 4, first and second ground terminal receiving cavities 101 and 102 receive first and second ground terminals 2 and 3, respectively. Insertion slot 103 receives ground element 4 and wings 44 and 45 extend through upper and lower ends of insertion slot 103. Therefore, first and second resilient contacts 42 and 43 of ground element 4 make contact with side walls 211 and 311 of ground terminals 2 and 3 via cutouts 1012 and 1022. Because ground element 4 contacts ground terminals 2 and 3 via resilient contacts 42 and 43, resilient contacts 42 and 43 of ground element 4 are effective in providing and maintaining a ground connection side walls 211 and 311 of ground terminals 2 and 3, respectively, despite fluctuations in dimensional tolerances.

Figure 5:
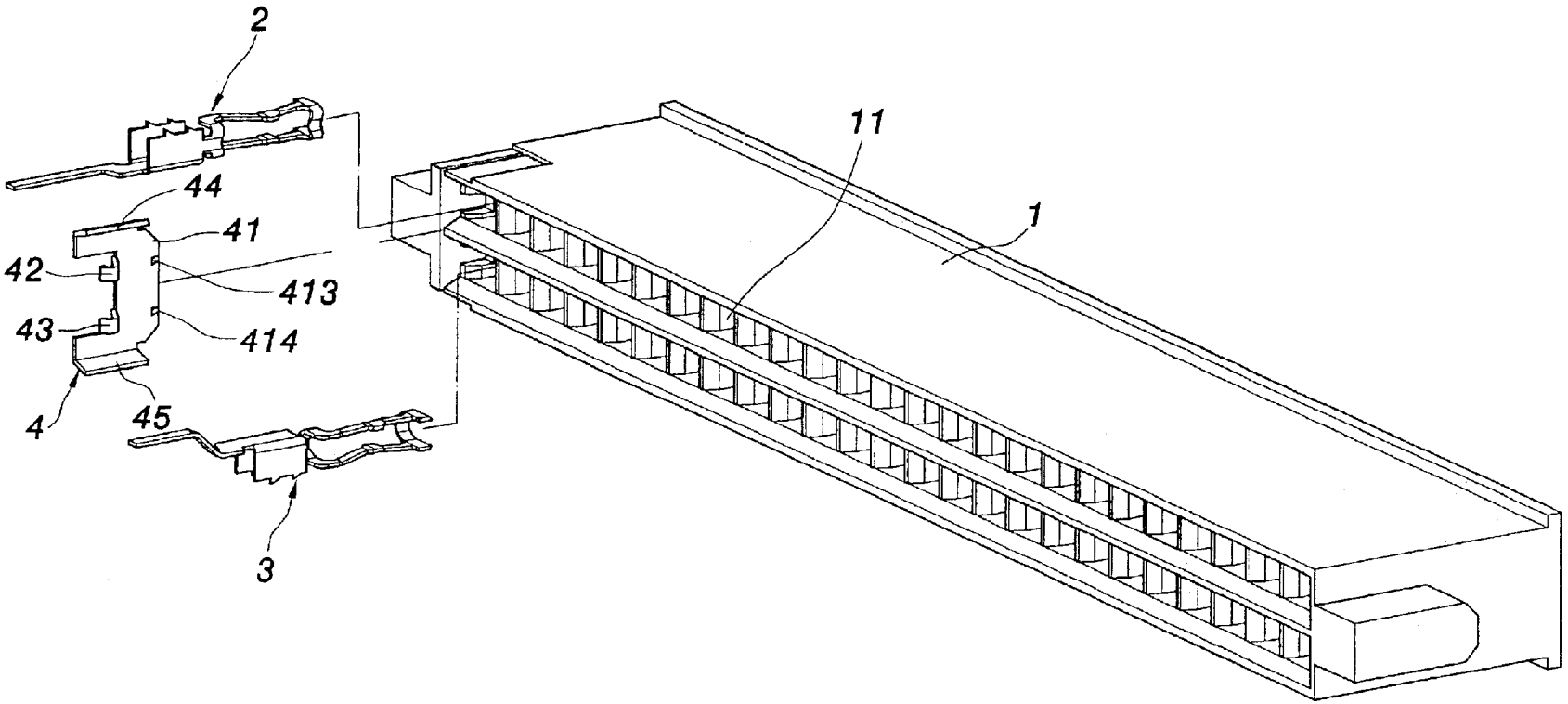
FIG. 5 is a perspective view of a ground element in accordance with another embodiment of the present invention.

Referring to FIGS. 3 and 4, ground element 4 further includes first and second fixing portions 411 and 412 formed on at least one side of body 41 for engaging side walls 1013 and 1023, respectively, of partitions 1011 and 1021, so that ground element 4 remains tightly engaged and positioned within insertion slot 103. First and second fixing partitions 411 and 412 may be formed by stamping or partially extruding the body to form partitions to engage with side walls 1013 and 1023. Alternatively, the fixing partitions may be in the form tabs or oblique extensions 413, 414 as shown in FIG. 5 to retain and position the body within insertion slot 103.

Figure 6:
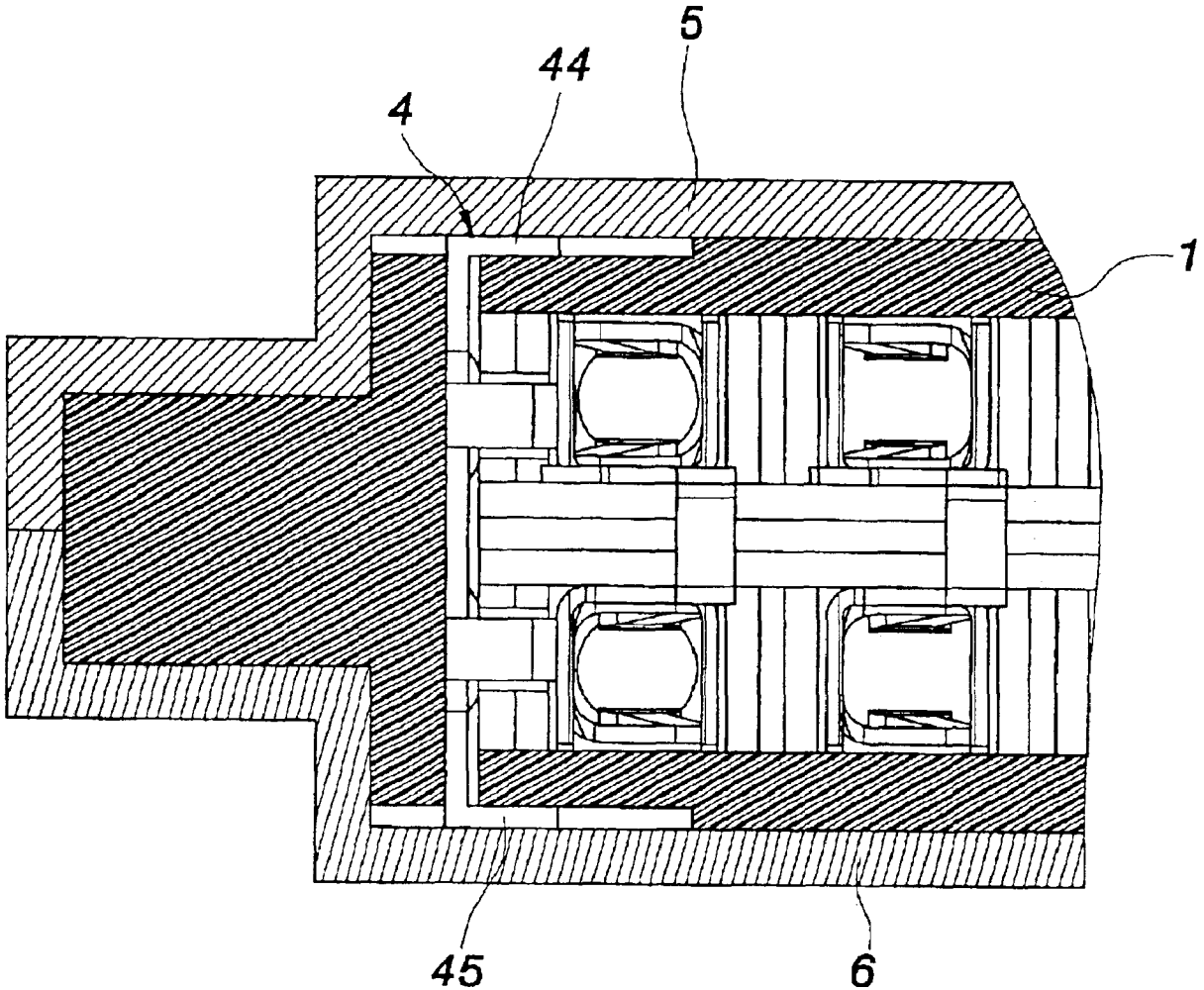
FIG. 6 is a cross-sectional view of the receptacle connector assembly coupled with the upper and lower cover plates in accordance with the present invention.

Referring to FIG. 6, a section of a memory card is shown with upper and lower cover plates 5 and 6 sandwiching insulative housing 1 therebetween. Wings 44 and 45 contact upper and lower cover plates 5 and 6 respectively to common the cover plates to the same electrical potential.

The structure of the present invention as described above, including ground element 4 in contact with first and second ground terminals 2 and 3 via resilient contacts 42 and 43, is effective in providing and maintaining a well-grounded connection in a memory card between the ground element and the cover plates without the risk of intermittent or open contacts. Ground terminal 4 is securely and accurately positioned in insertion slot 103 to provide this improved grounding function and is configured in a manner that facilitates manufacturing and assembly of the ground element.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed is:

1. A receptacle connector assembly for an electronic memory card, wherein the memory card includes upper and lower cover plates, and the receptacle connector assembly is sandwiched between the upper and lower cover plate, the receptacle connector assembly comprising:

an insulative housing having a plurality of terminal receiving cavities arranged in two rows, each row including at least one distal terminal receiving cavity adjacent a ground terminal insertion slot, each distal terminal receiving cavity including a partition defining a ground terminal receiving cavity on one side and the ground terminal insertion slot on the other side, each partition including a cutout formed therein;

a first ground terminal positioned in a first ground terminal receiving cavity in the first row of terminal receiving cavities;

a second ground terminal positioned in a second ground terminal receiving cavity in the second row of terminal receiving cavities, wherein the second ground terminal receiving cavity is positioned directly below the first ground terminal receiving cavity;

a ground element positioned in the ground terminal insertion slot, the ground element including a body, two wings extending from opposite ends of the body, and first and second resilient contacts extending from the body inward of the wings;

wherein the wings of the ground element contact the upper and lower cover plates, and the first and second resilient contacts contact the first and second ground terminals, respectively, to common the cover plates to the same electrical potential.

2. The receptacle connector assembly as set forth in claim 1, wherein the first and second resilient contacts of the ground element are positioned within the cutout of the respective partition in the ground terminal receiving cavity.

3. The receptacle connector assembly as set forth in claim 1, wherein the ground element further includes a fixing portion formed on the body for retaining and positioning the body within the insertion slot.

4. The receptacle connector assembly as set forth in claim 1, wherein the ground element includes first and second fixing portions formed on one side of the body inward of the wings for retaining and positioning the body within the insertion slot.

5. The receptacle connector assembly as set forth in claim 1, further including one ground terminal insertion slot at each end of the insulative housing and one distal ground terminal receiving cavity at each end of each row of terminal receiving cavities.

* * * * *